US009615702B2

(12) United States Patent
Calpe Gargallo

(10) Patent No.: US 9,615,702 B2
(45) Date of Patent: Apr. 11, 2017

(54) BODY DRYER ASSEMBLY AND BATHTUB OR SHOWER STALL ENCLOSURE PARTITION ASSEMBLY

(71) Applicant: Carlos Calpe Gargallo, Toronto (CA)

(72) Inventor: Carlos Calpe Gargallo, Toronto (CA)

( * ) Notice: Subject to any disclaimer, the term of this patent is extended or adjusted under 35 U.S.C. 154(b) by 542 days.

(21) Appl. No.: 14/099,203

(22) Filed: Dec. 6, 2013

(65) Prior Publication Data

US 2015/0196177 A1 Jul. 16, 2015

(30) Foreign Application Priority Data

Dec. 5, 2013 (CA) ..... 2836147

(51) Int. Cl.
*F26B 19/00* (2006.01)
*A47K 10/48* (2006.01)
*A47K 3/30* (2006.01)

(52) U.S. Cl.
CPC ..... *A47K 10/48* (2013.01); *A47K 3/30* (2013.01)

(58) Field of Classification Search
CPC .... F26B 21/004; F26B 21/005; F26B 21/006; F26B 3/02
USPC ... 34/218, 232, 233, 234, 235, 90, 915, 524, 34/572, 546, 554, 201, 202; 392/380, 381
See application file for complete search history.

(56) References Cited

U.S. PATENT DOCUMENTS

| | | | | |
|---|---|---|---|---|
| 3,128,161 | A | 4/1964 | Hudson | |
| 4,780,595 | A | 10/1988 | Alban | |
| 5,377,424 | A | 1/1995 | Albanes | |
| 5,873,179 | A | 2/1999 | Gregory et al. | |
| 6,148,539 | A | 11/2000 | Hatfield et al. | |
| 6,962,005 | B1 * | 11/2005 | Khosropour | A47K 10/48 34/218 |
| 8,051,629 | B2 * | 11/2011 | Pazdernik | B65B 61/12 219/388 |
| 2007/0151164 | A1 * | 7/2007 | Marshall | A47K 3/36 49/397 |

* cited by examiner

*Primary Examiner* — Kenneth Rinehart
*Assistant Examiner* — John McCormack

(57) ABSTRACT

There is provided in a preferred embodiment a bathtub or shower stall enclosure partition assembly. The partition assembly has an enclosure panel which includes interior and exterior facing major surfaces. The partition assembly also includes a dryer manifold assembly having a manifold array with at least one air exhaust conduit provided with an air receiving end and an air dispensing outlet. The partition assembly further includes an air drive assembly comprising an air transfer duct extending from an air inlet to an air supply interface, and a heating element assembly selectively operable to provide a heated air flow. The supply interface is for fluid communication with the air receiving end whereby actuation of the heating element assembly provides the heated air flow through the air exhaust conduit and outwardly therefrom via the air dispensing outlet as the drying air flow.

33 Claims, 18 Drawing Sheets

BODY DRYER ASSEMBLY AND BATHTUB OR SHOWER STALL ENCLOSURE PARTITION ASSEMBLY

FIELD OF THE INVENTION

This invention relates to a body dryer assembly, or more particularly a body dryer assembly for providing a body or hair drying air flow in a bathtub or shower stall. The invention further relates to a bathtub or shower stall enclosure partition assembly, which most preferably includes a generally planar enclosure panel, a dryer manifold assembly and an air drive assembly.

BACKGROUND OF THE INVENTION

A number of blow dryers and other electromechanical devices for providing hot and/or cold air are available for use in accelerating evaporation of moisture and water remaining on a user after a shower or bath. By way of an example, U.S. Pat. No. 5,377,424 to Albanes describe a body drying system for positioning between a towel rack and a wall for drying a towel and/or a user. The system includes a rectangular housing containing a heating element positioned adjacent to a forward face of the housing, and which is provided with a number of apertures on the forward face. Albanes suggests that when positioned between a wall and a towel rack such that a towel supporting rail of the towel rack is located in front of the housing forward face, and beneath an upper surface, the system allows for multiple uses for drying a robe or towel placed on the towel rack, as well as for drying a user positioned in front of the system.

U.S. Pat. No. 5,873,179 to Gregory describes an air distribution panel for mounting to a wall, and which is fluidically coupled to a blower/motor assembly. The air distribution panel includes a number of vertically extended riser ducts, each riser duct having a series of vertically spaced air flow nozzles. The riser ducts receive forced heated or cool air from the blower/motor assembly, and dispense the forced air outwardly through the air flow nozzles, and toward a user. Gregory describes that the riser ducts have a tapered configuration towards a closed top end, such that the volume of air continually decreases from a bottom end portion towards a top end portion. Gregory suggests that the tapered configuration allows the velocity of air dispensed through the vertically spaced air flow nozzles to remain uniform and constant, and without requiring use of baffles, dampers, throttles or valves.

U.S. Pat. No. 6,148,539 to Hatfield describes a body drier system which includes a pair of opposed side walls and a top face extending between top edges of the side walls. A channel located within the side walls extends to the top face, so as to provide fluid communication between vent assemblies mounted on an interior portion of the side walls and a blower assembly coupled to the top face. The blower assembly provides hot or cold air through the channel and out of the vent assemblies to a user positioned between the side walls.

A number of known body or hair dryer devices suffer the disadvantages in that the devices may not permit direct installation in an existing bathroom, bathtub or shower stall without requiring significant reconfigurations and modifications. Furthermore, a number of known devices include electrical components which may easily come in contact with water or water sources during use, and may therefore pose potential significant health and safety risk to users. Other known devices such as that of Albanes described above are located away from a bathtub or shower stall, such that a user could not be dried shortly after taking a bath or shower.

SUMMARY OF THE INVENTION

In view of some of the disadvantages of known devices, one possible non-limiting object of the present invention is to provide a body dryer assembly which may permit simpler installation near or in a bathtub or shower stall, and which may allow for convenient and rapid drying of the body and/or hair shortly after taking a bath or shower.

Another possible non-limiting object of the present invention is to provide a bathtub or shower stall enclosure partition assembly which may operate to perform multiple functions as a partial or full enclosure structure for preventing water from travelling outside a bathtub or shower stall, and as an integrated body dryer for drying a user prior to stepping out of the bathtub or shower stall.

Another possible non-limiting object of the present invention is to provide a body dryer assembly, or bathtub/shower stall enclosure partition assembly of improved aesthetic qualities, and which incorporates highly customizable components allowing modifications to add, change or remove graphics and designs, and to selectively arrange air outlet modules in a number of user-selectable configurations.

Another possible non-limiting object of the present invention is to provide a body dryer assembly, or bathtub/shower stall enclosure partition assembly configured for reducing or minimizing potential hazards and health risks to a user, such as injuries or deaths which may be caused by contact with electrical components and water or moisture during operation.

In one simplified aspect, the present invention provides a body dryer assembly, or bathtub/shower stall enclosure partition assembly which includes a panel or enclosure panel; an air drive assembly; and a dryer manifold assembly.

In another aspect, the present invention provides a body dryer assembly for providing a body or hair drying air flow in a bathtub or shower stall, the dryer assembly comprising: a generally planar panel positionable in an erected position on or adjacent to the bathtub or shower stall, the panel comprising interior and exterior facing major surfaces; an air drive assembly comprising: a columnar support for securing the panel in the erected position, the columnar support defining a substantially vertical channel sized for receiving a lateral edge of the panel in the securement of the panel thereto; an air transfer duct extending from an air inlet to an air supply interface, the air transfer duct being disposed in or coupled to the columnar support; and a heating element assembly selectively operable for providing a heated air flow from the air inlet to the air supply interface, the heating element assembly being disposed in or coupled to the columnar support; and a dryer manifold assembly for dispensing the drying air flow, the dryer manifold assembly being mountable to the columnar support or the air transfer duct in a cantilevered arrangement thereto, wherein the dryer manifold assembly comprises a manifold array positionable adjacent to the interior facing major surface, the manifold array comprising at least one air exhaust conduit having an air receiving end and an air dispensing outlet; wherein the air supply interface is provided for fluid communication with the air receiving end whereby actuation of the heating element assembly provides the heated air flow through the at least one air exhaust conduit and outwardly therefrom via the air dispensing outlet as the drying air flow.

In yet another aspect, the present invention provides a bathtub or shower stall enclosure partition assembly comprising: a generally planar enclosure panel positionable in an erected position at least partially enclosing a bathtub or shower stall, the enclosure panel comprising interior and exterior facing major surfaces; a dryer manifold assembly for providing a body or hair drying air flow, the dryer manifold assembly comprising a manifold array positionable adjacent to the interior major surface, wherein the manifold array comprises at least one air exhaust conduit having an air receiving end and an air dispensing outlet; and an air drive assembly comprising an air transfer duct extending from an air inlet to an air supply interface, and a heating element assembly selectively operable to provide a heated air flow from the inlet to the supply interface, the supply interface being provided for fluid communication with the air receiving end whereby actuation of the heating element assembly provides the heated air flow through the at least one air exhaust conduit and outwardly therefrom via the air dispensing outlet as the drying air flow.

The air drive assembly preferably includes a columnar support for securing the panel in the erected position, the columnar support defining a substantially vertical channel sized for receiving a lateral edge of the panel in the securement of the enclosure panel thereto, and wherein the air transfer duct and the heating element assembly are coupled to or disposed in the columnar support. The columnar support most preferably defines generally parallel wet and dry elongated chambers fluidically joined by a transverse duct, the chambers being spaced apart from each other to define the vertical channel therebetween whereby the wet elongated chamber is positionable adjacent to the interior facing major surface and the dry elongated chamber is positionable adjacent to the exterior facing major surface, and wherein the heating element assembly is coupled to or disposed in the dry elongated chamber. Most preferably, the heating element assembly is disposed in the dry elongated chamber.

Preferably, the columnar support comprises bifurcated wet and dry columnar housings defining the wet and dry elongated chambers, respectively, wherein the vertical channel extends from a first lateral surface of the columnar support to the second other lateral surface opposed to the first lateral surface between the columnar housings, and wherein an interior surface of the dry columnar housing is positionable in substantially abutting contact with the exterior facing major surface and an interior surface of the wet columnar housing with the interior facing major surface. In one embodiment, the panel extends laterally from the first lateral surface. In an alternative embodiment, the panel extends laterally from both the first and second lateral surfaces.

The transverse duct is preferably fluidically coupled to the wet and dry columnar housings at respective upper longitudinal portions, or between upper and lower longitudinal portions. Most preferably, the transverse duct is fluidically coupled to the wet and dry columnar housings at respective upper longitudinal ends.

The respective interior surfaces of the wet and dry columnar housings are preferably configured to securely engage the major surfaces of the panel. In one embodiment, the interior surfaces of the columnar housings comprise a plurality of deformable or compression members for frictionally engaging the panel therebetween. In one embodiment, the interior surfaces comprise knurled or friction surfaces, or an adhesive to effect permanent or selectively removable engagement with the panel. In one embodiment, the interior surfaces and the panel define one or more sets of transversely aligned bolt-receiving apertures sized to receive a panel attachment bolt in the securement of the panel to the air drive assembly.

Preferably, the body dryer assembly or the enclosure partition assembly includes an electrical/thermal insulation member for improved safety and/or electrical efficiency. It is to be appreciated that the insulation member is not particularly limited, and may include plastics and polymers such as acrylonitrile butadiene styrene (ABS), polyimide, polyether ether ketone (PEEK), polyethylene terephthalate, polyphenylene sulfide, and polystyrene. It is to be appreciated that a person skilled in the art would readily recognize other insulation materials suitable for use with the invention.

Most preferably, the insulation member is included with the air drive assembly, columnar support or wet/dry elongated chambers to prevent contact with moisture, water and steam from the bathtub or shower stall.

For installation near a bathtub, the columnar support preferably includes a bottommost anchoring surface for securing the body dryer or partition assembly to a top surface of a bathtub sidewall. The columnar support preferably includes a lateral attachment surface for securing the body dryer or partition assembly to the shower stall, or a wall adjacent to the bathtub or shower stall. The anchoring or attachment surface may incorporate or include one or more additional components for stably attaching the body dryer or partition assembly to a bathtub sidewall, a shower stall or a wall adjacent thereto, and which may for example include anchoring screw or bolt plates, suction cups, adhesive tapes, and others.

In one embodiment, the panel is a shower stall door or wall. The enclosure is preferably a hinged shower stall door, and the columnar support comprises an enclosure hinge for hingedly coupling the shower stall door to the shower stall. In another embodiment, the panel is a sliding or hinged bathtub enclosure panel door.

The panel preferably comprises a semi-transparent or transparent panel, or most preferably a glass panel for at least partially enclosing the bathtub or shower stall. One or both of the interior and exterior facing major surfaces preferably include pre-installed graphics or designs secured thereon, or are adapted or surface treated for selectively attaching or removing user selectable graphics or designs thereon. In a preferred embodiment, the graphics or designs includes animated characters, sports team signs or logos, national flags, photographs and/or others.

The dryer manifold assembly is most preferably mountable to the columnar support or the air transfer duct in a cantilevered arrangement thereto.

Preferably, the air supply interface comprises an air venting surface defining an array of air vents, the air venting surface comprising a selectively removable sealing cover or knockout portion for selectively permitting or preventing air flow through each said vent, and wherein the manifold array includes a plurality of said air exhaust conduits selectively connectable in fluid communication with the air vents.

In one embodiment, the manifold array comprises a plurality of said air exhaust conduits, each said conduit being an elongated conduit having a plurality of said air dispensing outlets, wherein the elongated conduit is positionable in a generally parallel orientation to the interior major surface with the air dispensing outlets oriented substantially normal to the interior major surface.

In one embodiment, the air exhaust conduit comprises a plurality of modular interconnectable conduits, each said modular conduit being fluidically coupleable to one or more of other said modular conduits, and wherein the modular conduits are selectively positionable in and demountable from a geometric configuration.

The dryer manifold assembly preferably further includes an air distribution multiplier connectable in fluid communication with the air supply interface and the air receiving end.

In one embodiment, the manifold array includes an interior facing display surface having pre-installed graphics or designs secured thereon, or which is adapted for selectively attaching or removing user selectable graphics or designs thereon. In a preferred embodiment, the graphics or designs includes animated characters, sports team signs or logos, national flags, photographs and/or others. In another embodiment, the manifold array comprises an exterior housing having a shape of an animated character, an animal, a plant, a sports team sign or logo, or a national flag.

The heating element assembly preferably includes: a motor, engine or fan adapted for moving or driving an air flow from the air inlet and outwardly from the air dispensing outlet; a resistance heating element for heating the air flow; a control element for selectively activating or deactivating the heating element assembly; and a power supply. Most preferably, the power supply is a removable rechargeable battery, and the columnar support or the dry columnar housing defines a battery receiving slot sized for selectively receiving the battery therein. The rechargeable battery is not particularly limited, and may include a nickel-cadmium (NiCd) battery, a nickel-metal hydride (NiMH) battery, lithium ion battery, and/or lithium-ion polymer battery.

In one embodiment, the control element comprises an electrical switch for selectively activating the motor and the resistance heating element. The heating element assembly preferably further comprises an audio system activatable by the switch for emitting a pre-recorded sound signal.

Additional and alternative features of the present invention will be apparent to a person skilled in the art from the following detailed description of the preferred embodiments thereof.

BRIEF DESCRIPTION OF THE DRAWINGS

Reference may now be had to the following detailed description taken together with the accompanying drawings in which.

DETAILED DESCRIPTION OF THE PREFERRED EMBODIMENTS

Figure 1:
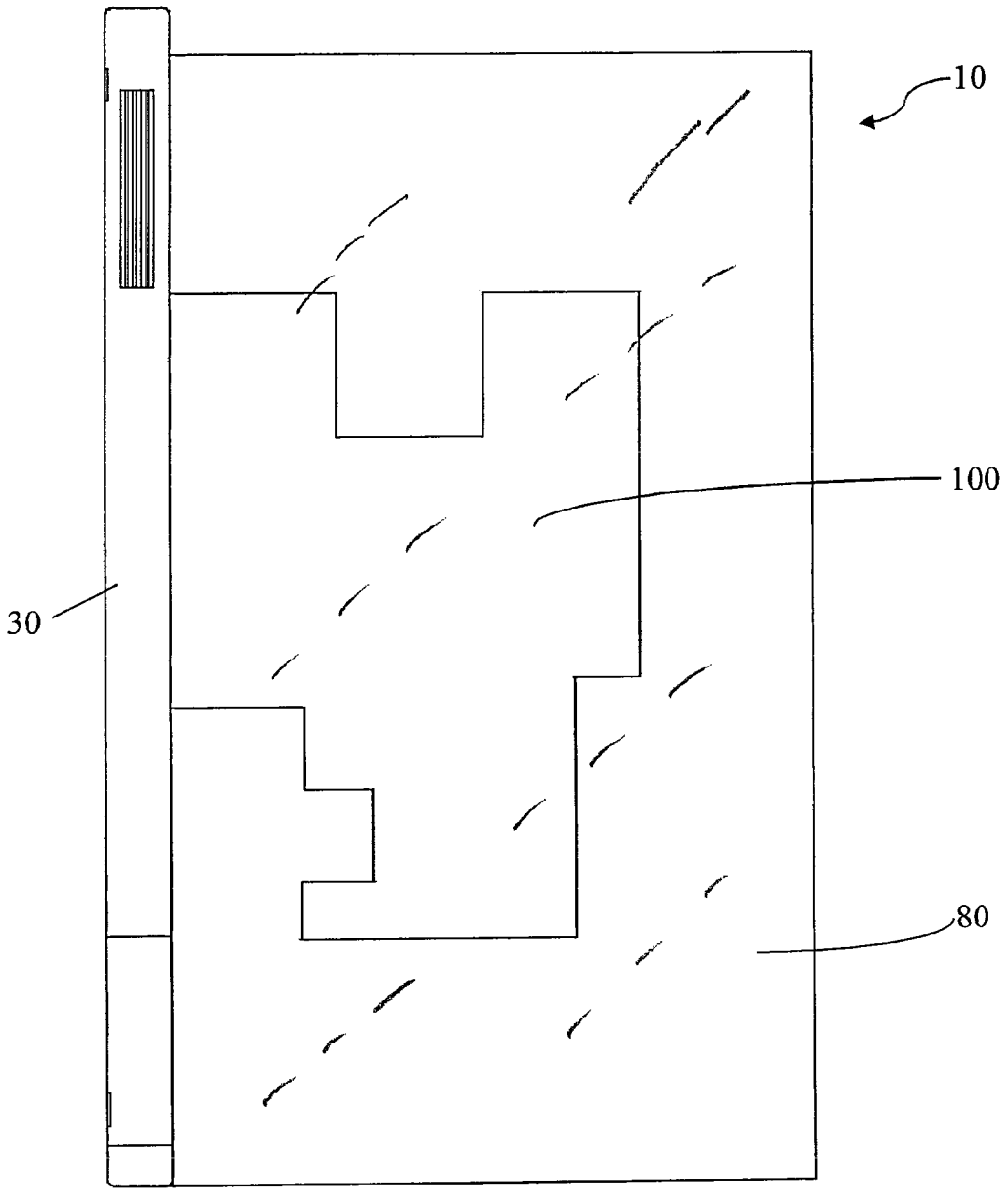
FIG. 1 is an exterior elevation view of a bathtub enclosure partition assembly in accordance with a preferred embodiment of the present invention.
Figure 2:
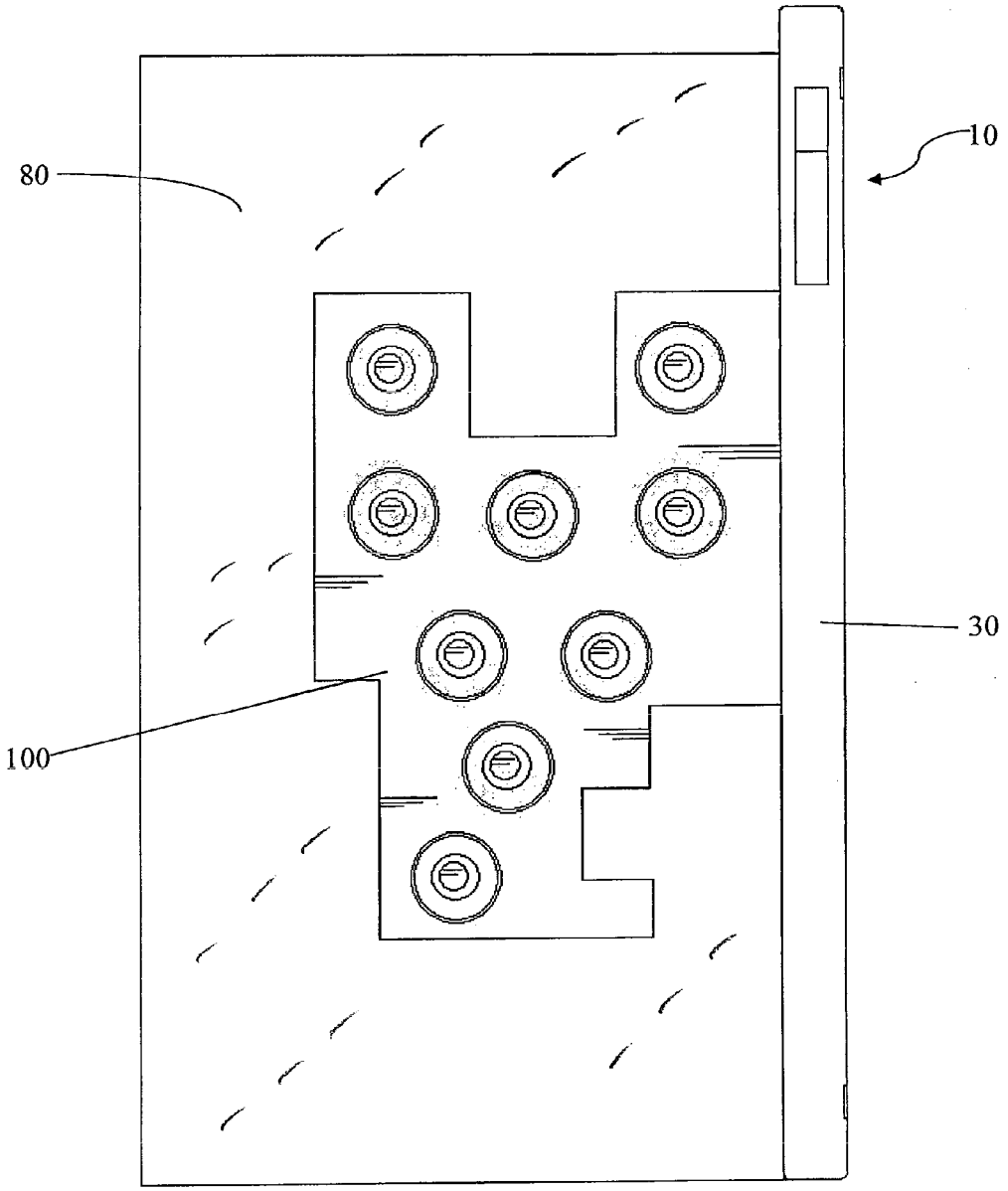
FIG. 2 is an interior elevation view of the bathtub enclosure partition assembly shown in FIG. 1.

Reference is made to FIG. 1 which shows an exterior elevation view of a bathtub enclosure partition assembly 10 in accordance with a preferred embodiment of the present invention. As will be described, the bathtub enclosure partition assembly 10 includes a drying air flow supply assembly 30, an enclosure panel, planar panel or enclosure glass pane 80, and a drying air flow dispensing assembly or manifold array 100. FIG. 2 illustrates an interior elevation view of the enclosure partition assembly 10.

Figure 3:
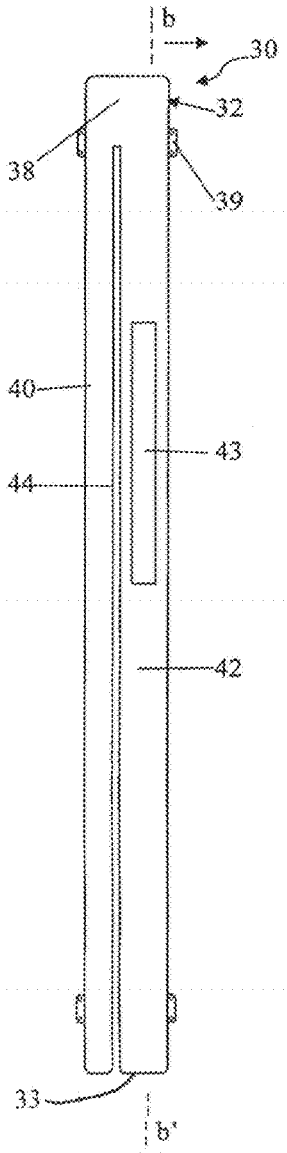
FIG. 3 is a lateral elevation view of a drying air flow supply assembly of the bathtub enclosure partition assembly shown in FIG. 1.
Figure 4:
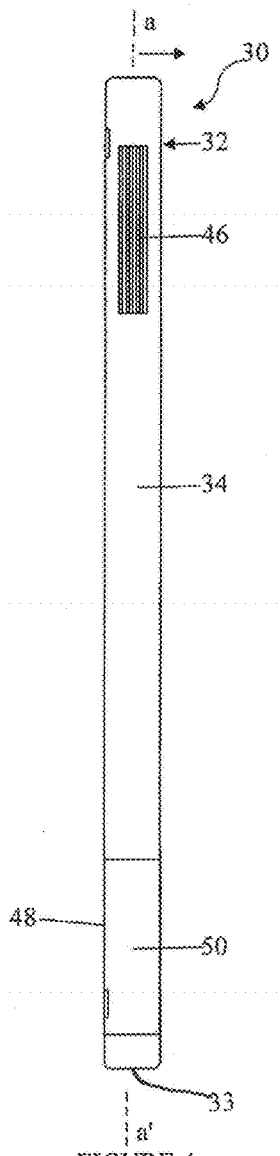
FIG. 4 is an exterior elevation view of the drying air flow supply assembly shown in FIG. 3.
Figure 5:
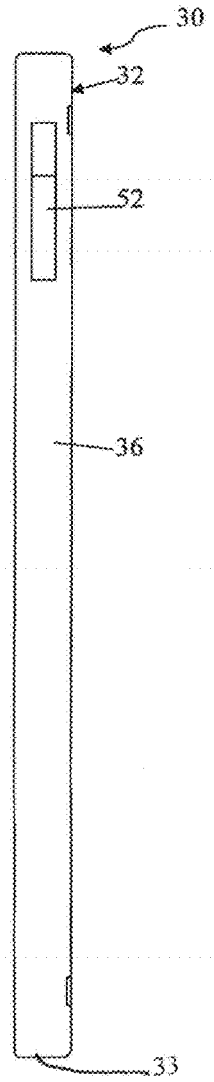
FIG. 5 is an interior elevation view of the drying air flow supply assembly shown in FIG. 3.

Reference is made to FIGS. 3 to 5 which show lateral, exterior and interior elevation views of the drying air flow supply assembly 30. The supply assembly 30 has a columnar support or vertically extended support housing 32 which includes an exterior facing surface 34, an interior facing surface 36, and a lateral glass pane supporting surface 38 and a lateral wall attachment surface opposed to the glass pane supporting surface 38 (not shown). As seen in FIG. 3, the support housing 32 is formed with bifurcated exterior and interior housing portions 40, 42 laterally spaced apart from each other to define a glass pane engagement cannel 44 therebetween, and are integrally joined at respective upper portions to form a single support housing unit.

Provided on the lateral wall attachment surface in a generally co-planar orientation therewith are wall attachment bracket plates 39 each defining a pair of screw holes for receiving attachment screws in the securement of the support housing 32 to an adjacent wall. As seen in FIG. 3, the glass pane supporting surface 38 defines an air vent or air flow supply port 43 which opens to the interior housing portion 42.

Although not strictly limited, the support housing 32 preferably extends between about 500 mm to about 1500 mm in height, and more preferably between about 700 mm and about 1200 mm. Furthermore, the support housing 32 preferably extends between about 50 mm and about 200 mm between the exterior and interior facing surfaces 34, 36, and between about 40 mm and about 100 mm between the supporting surface 38 and the wall attachment surface. The engagement channel 44 preferably extends upwardly between about 400 mm to about 1400 mm from a bottommost surface of the support housing 32.

Figure 6:
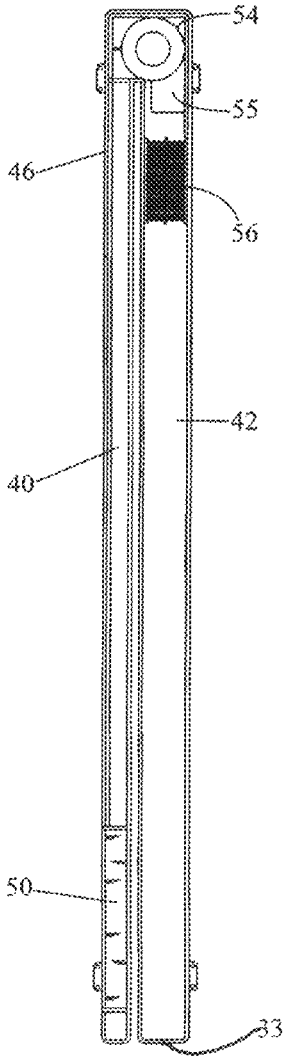
FIG. 6 is a cross-sectional view of the drying air flow supply assembly shown in FIG. 4, and which is taken along the line a-a'.

As seen in FIG. 4, the exterior facing surface 34 defines on an upper portion an air inlet 46 for permitting a constant flow of ambient air into an interior chamber of the support housing 32. Provided over the air inlet 46 are a number of vertical bars or strips laterally spaced apart from each other to prevent larger solid objects from entering through the air inlet 46, and without significantly affecting or reducing air flow therethrough. The exterior facing surface 34 furthermore defines on a lower portion a power supply retention slot 48 which extends into the exterior housing portion 40 (as shown in FIG. 6), and which is sized for removably retaining a removable rechargeable battery 50. It is to be appreciated that while the retention slot 48 is shown with the removable battery 50 disposed therein, the retention slot 48 may be configured to receive other power supply components, such as an electrical power converter connected to an electrical plug.

As seen in FIG. 5, the interior facing surface 36 includes a body dryer power switch 52 for activating a tangential air flow fan 54 and a resistance heating coiled wire 56 as will be described below.

Figure 7:
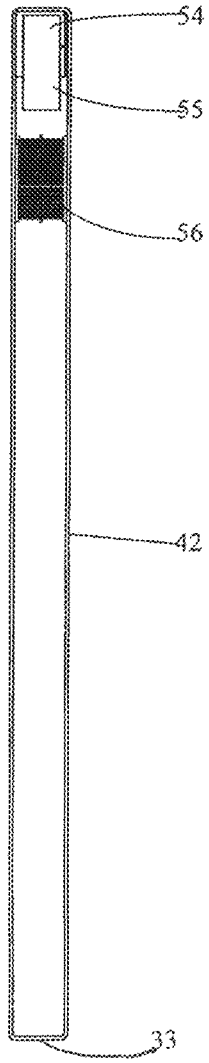
FIG. 7 is a cross-sectional view of the drying air flow supply assembly shown in FIG. 3, and which is taken along the line b-b'.

As seen in FIGS. 6 and 7, the tangential air flow fan 54 is fixedly encased within an uppermost portion of the support housing 32, and above the air inlet 46. The air flow fan 54 includes an open-ended fan housing opening to the exterior housing portion 40 on one end and the interior housing portion 42 on the other, and which is provided with a selectively activatable impeller rotatably secured in the fan housing (not shown). The impeller is oriented within the fan housing to drawn in ambient air through the air inlet 46, and propel the drawn air outwardly through a fan nozzle 55 towards the interior housing portion 42. Disposed in the interior housing portion 42 and below the fan nozzle 55 in the direction of the air flow is the resistance heating coiled wire 56 selectively operable for heating the air flow. Both the air flow fan 54 and the coiled wire 56 are electrically coupled to and powered by the battery 50, and operated by the power switch 52.

Figure 8:
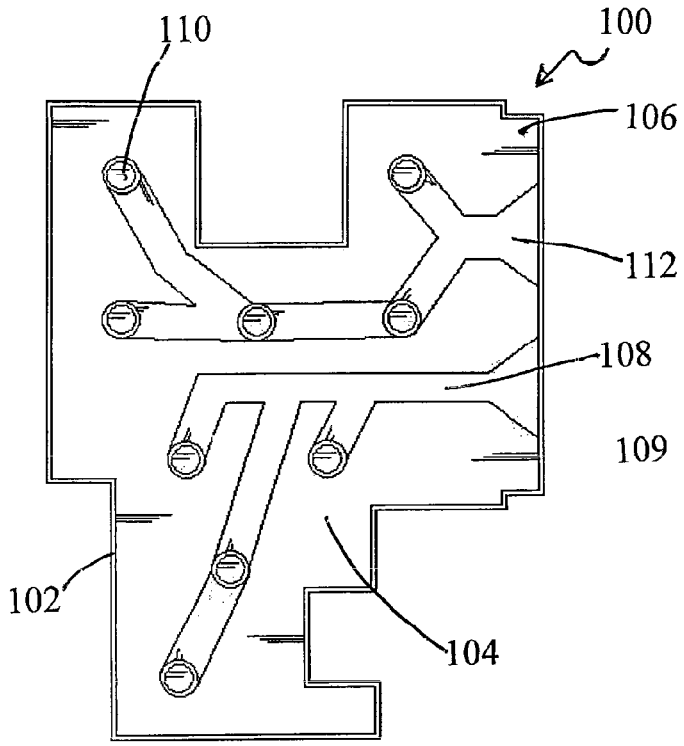
FIG. 8 is a cross-sectional view of a drying air flow dispensing assembly of the bathtub enclosure partition assembly shown in FIG. 1.
Figure 9:
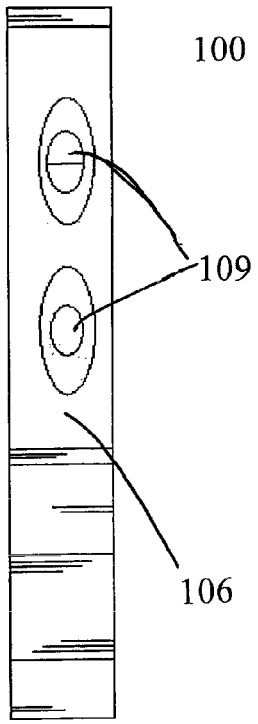
FIG. 9 is a lateral elevation view of the drying air flow dispensing assembly shown in FIG. 8.

Reference is made to FIGS. 8 and 9 which illustrate the drying air flow dispensing assembly 100. The dispensing assembly 100 has a cantilevered manifold body 102 which defines an enclosed chamber 104, and which includes a lateral air receiving portion 106 extending horizontally from the manifold body 102. The air receiving portion 106 has external dimensions sized for engagable insertion into the air flow supply port 43 of the support housing 32 when fully assembled as will be described below. Extending laterally from the air receiving portion 106 and into the interior chamber 104 are air exhaust conduits or air conduit channels 108 which include an air receiving end 109 cooperatively defined with the air receiving portion 106, and which open to a plurality of air dispensing outlets 110 at various distances from the air receiving portion 106. Each of the dispensing outlets 110 are oriented at a substantially orthogonal orientation to the plane of the manifold body 102. To provide for increased air velocity at the dispensing outlets 110, the conduit channels 108 includes a tapered conduit section 112 proximal to the air receiving portion 106, and which decreases in diameter as it extends away from the air receiving portion 106.

Although not strictly limited, the manifold body 102 measures between about 300 mm and 1200 mm in height, between about 300 mm and 1200 mm in width, and between about 30 mm and about 100 mm in depth. Furthermore, the glass pane 80 measures between about 400 mm and about 1400 mm in height, between about 400 mm and 1800 mm in width and between about 2 mm and 10 mm in thickness.

Figure 10:
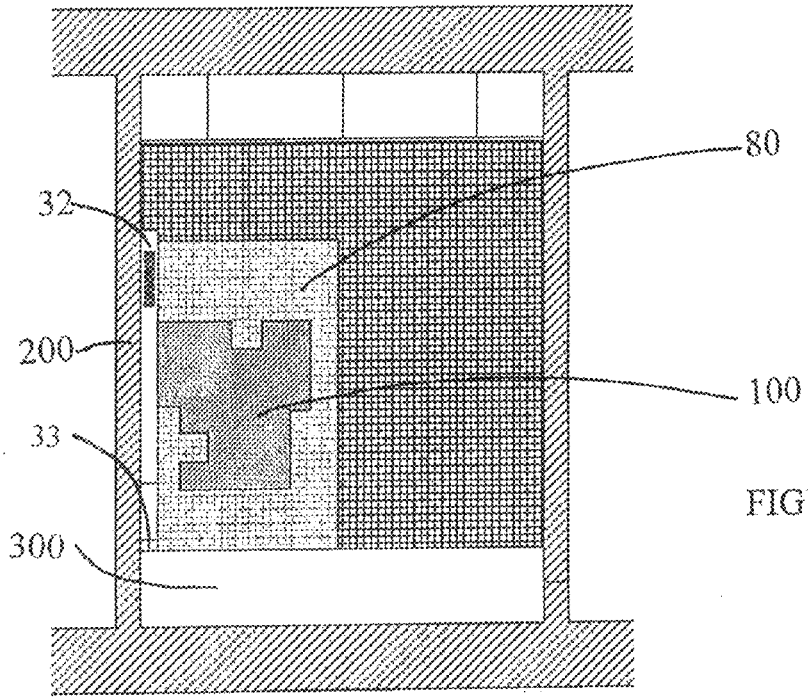
FIG. 10 is an exterior elevation view of the bathtub enclosure partition assembly shown in FIG. 1, and which is installed on a bathtub.
Figure 11:
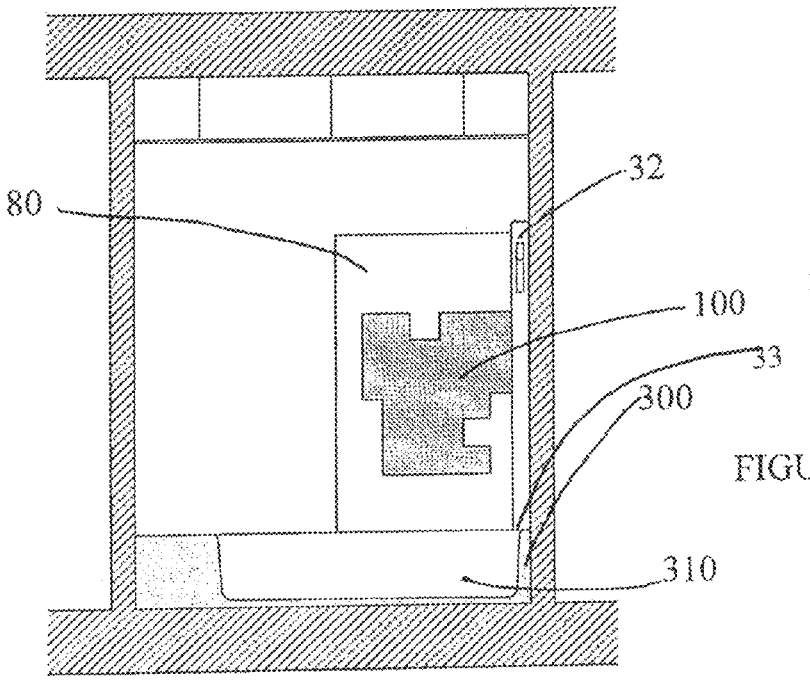
FIG. 11 is an interior elevation view of the installed bathtub enclosure partition assembly shown in FIG. 10.
Figure 12:
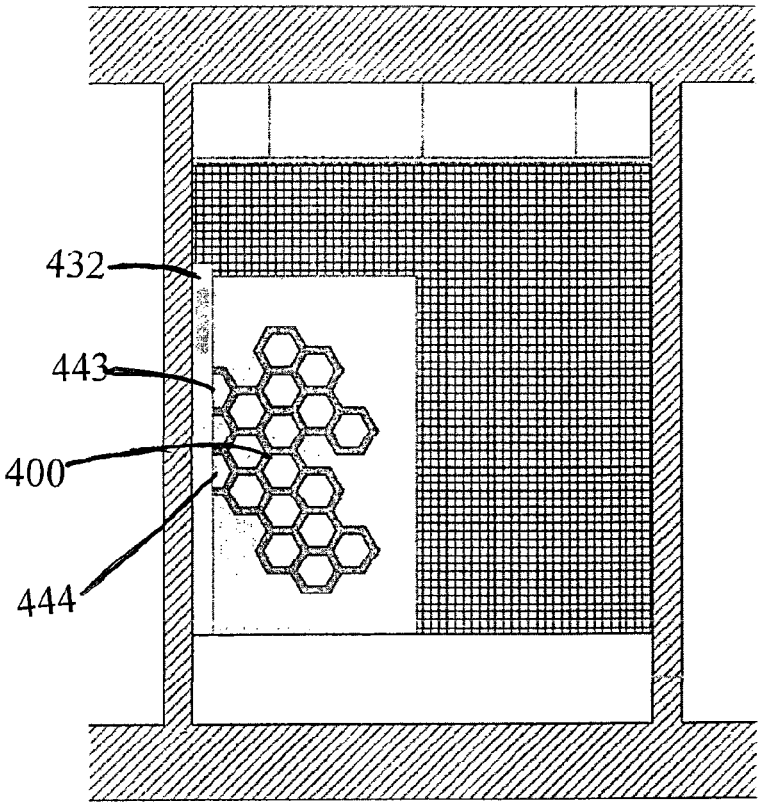
FIG. 12 is an exterior elevation view of a bathtub enclosure partition assembly in accordance with a preferred embodiment of the present invention installed on a bathtub, and which is provided with a honeycomb patterned drying air flow dispensing assembly.
Figure 13:
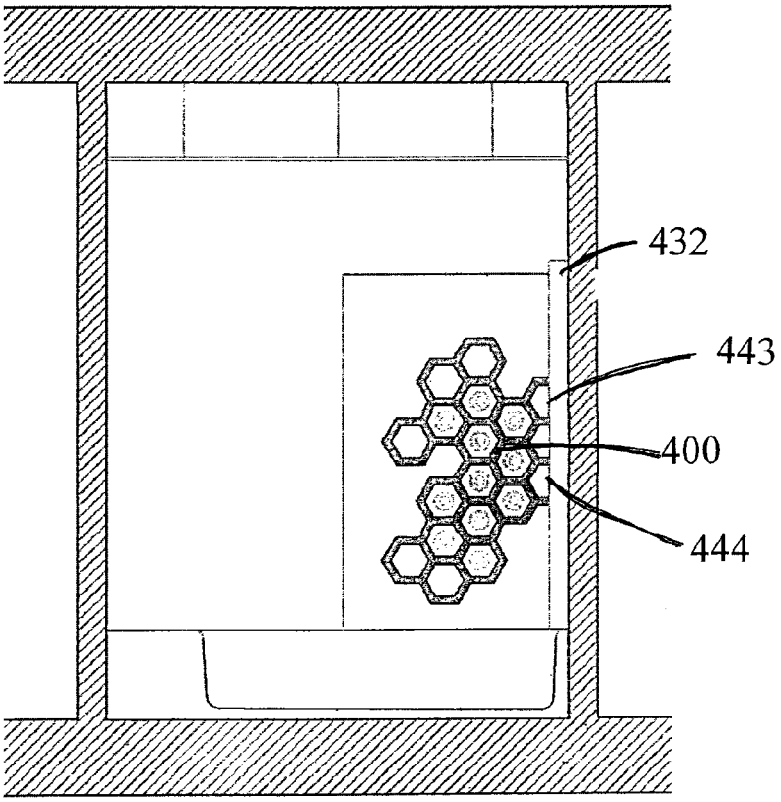
FIG. 13 is an interior elevation view of the installed bathtub enclosure partition assembly shown in FIG. 12.
Figure 14:
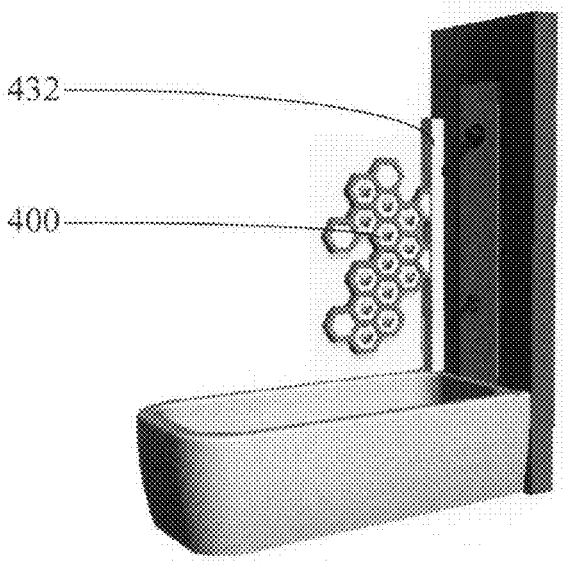
FIG. 14 is a perspective view of the installed bathtub enclosure partition assembly shown in FIG. 12.
Figure 15:
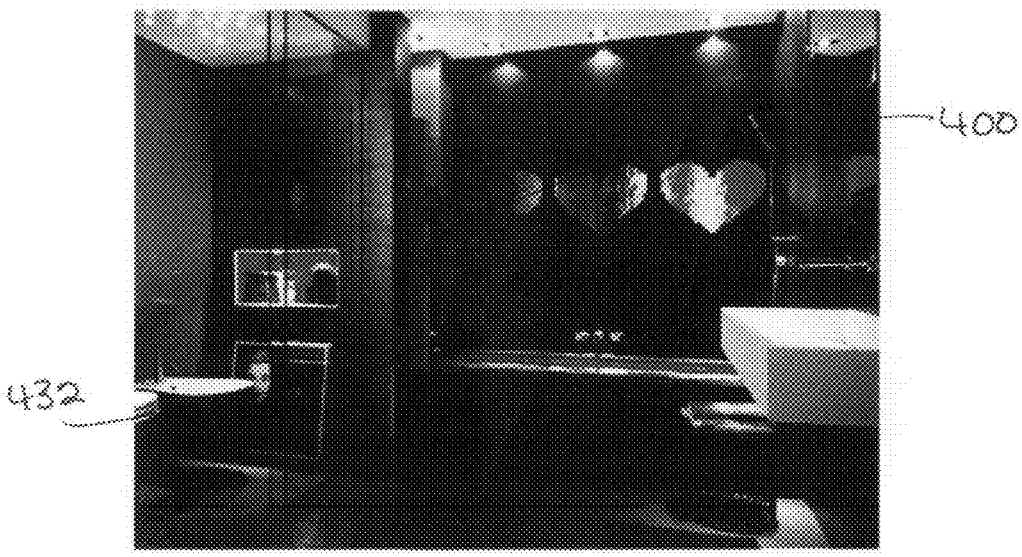
FIG. 15 is a computer generated photographic image of the installed bathtub enclosure partition assembly shown in FIG. 12.
Figure 16:
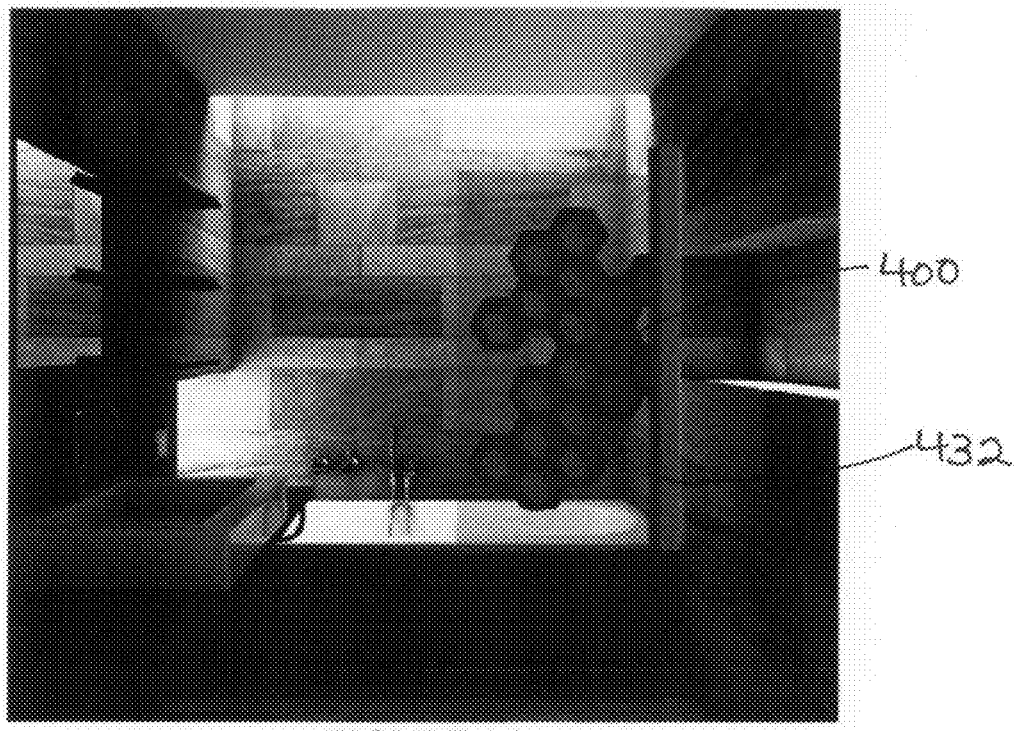
FIG. 16 is a computer generated photographic image of the installed bathtub enclosure partition assembly shown in FIG. 12.
Figure 17:
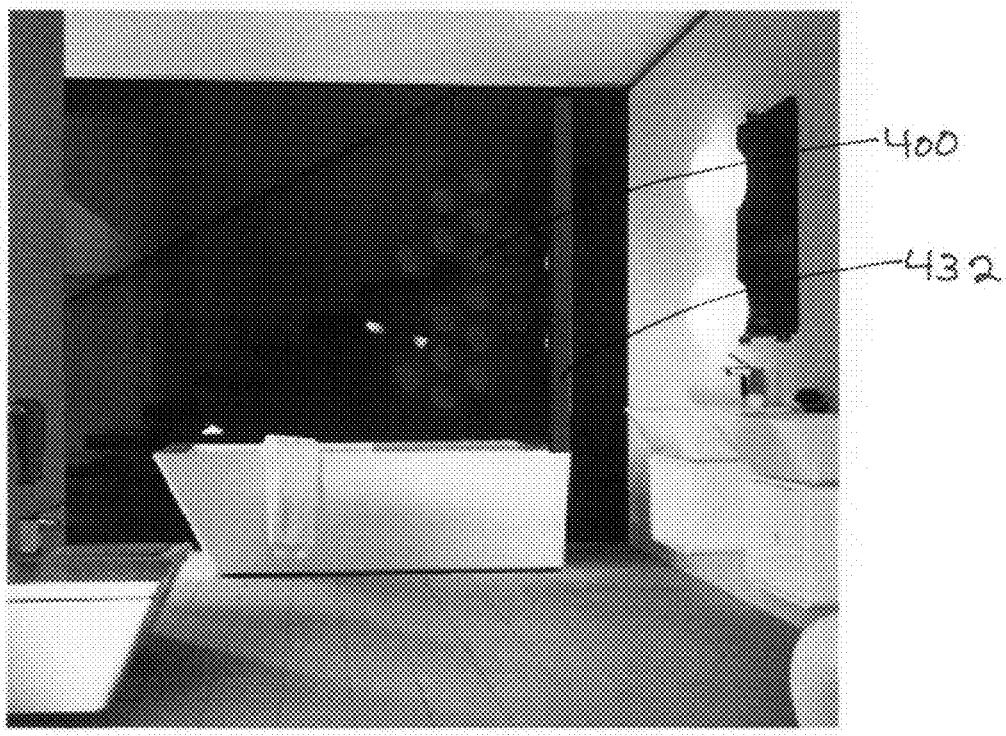
FIG. 17 is a computer generated photographic image of the installed bathtub enclosure partition assembly shown in FIG. 12.
Figure 18:
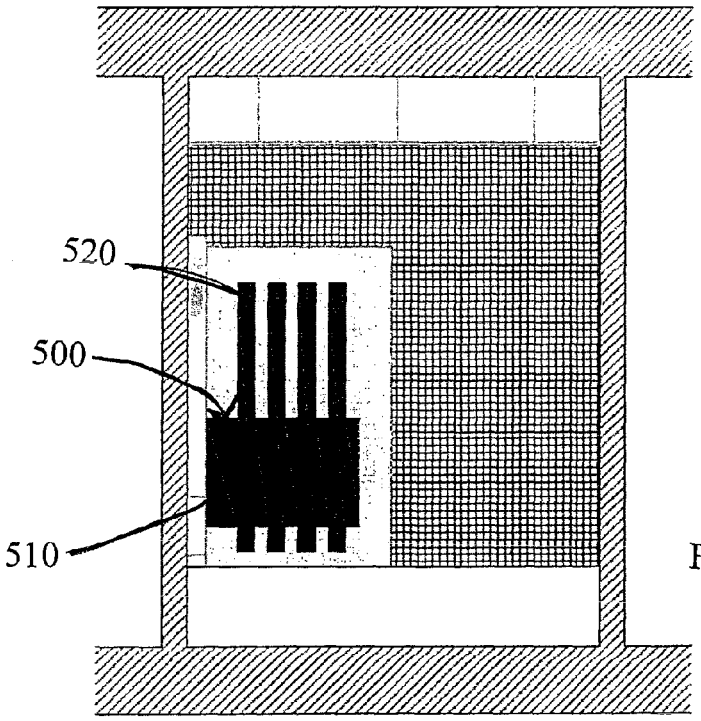
FIG. 18 is an exterior elevation view of a bathtub enclosure partition assembly in accordance with a preferred embodiment of the present invention installed on a bathtub, and which is provided with a drying air flow dispensing assembly having a drying air distribution multiplier fluidically coupled to vertical slab air dispensing units.
Figure 19:
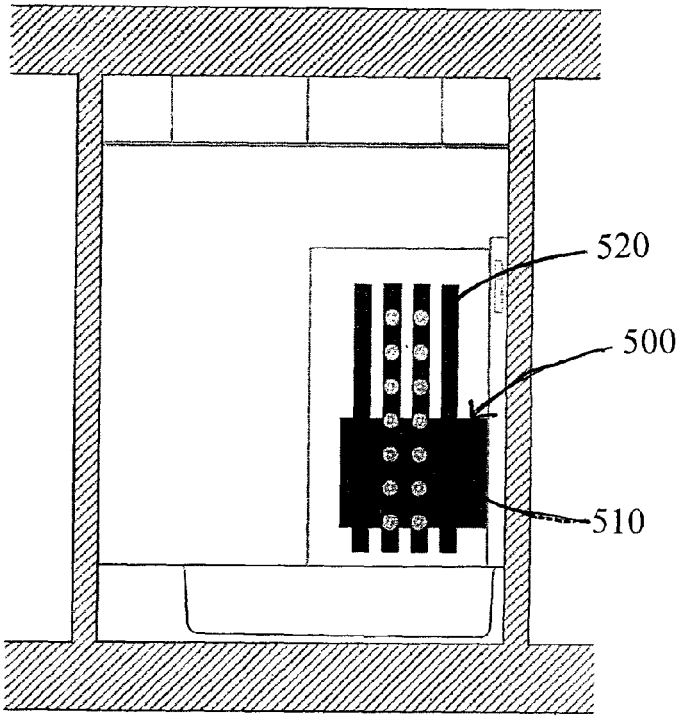
FIG. 19 is an interior elevation view of the installed bathtub enclosure partition assembly shown in FIG. 18.
Figure 20:
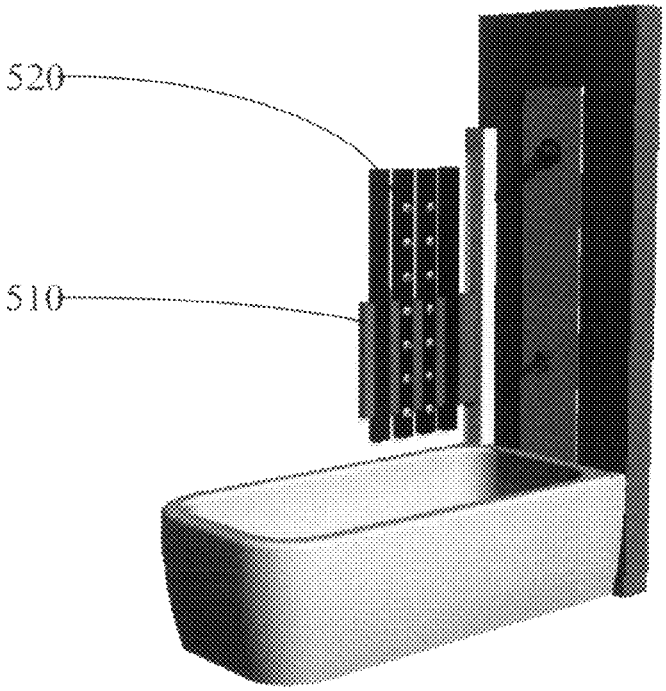
FIG. 20 is a perspective view of the installed bathtub enclosure partition assembly shown in FIG. 18.
Figure 21:
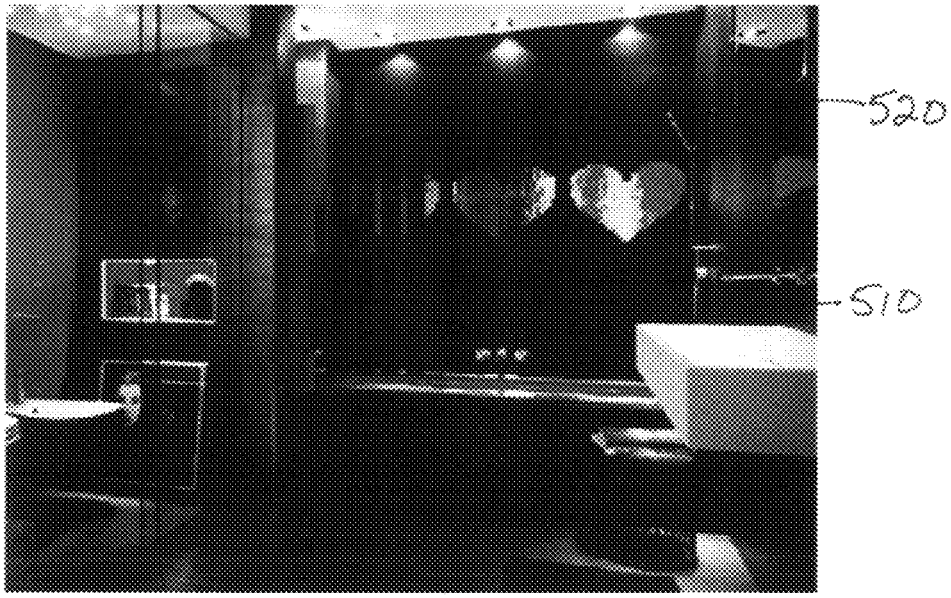
FIG. 21 is a computer generated photographic image of the installed bathtub enclosure partition assembly shown in FIG. 18.
Figure 22:
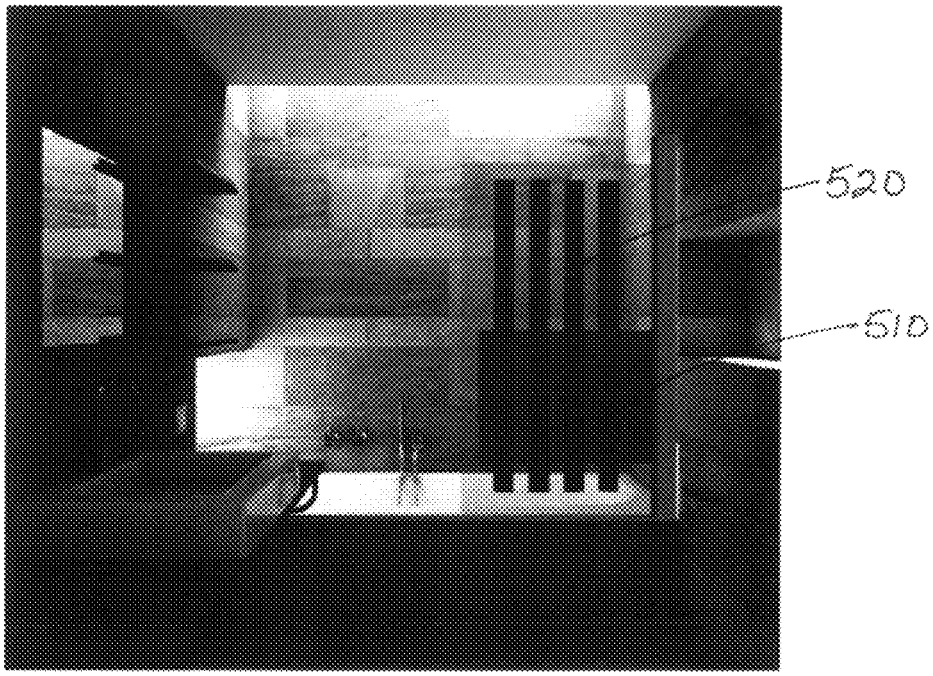
FIG. 22 is a computer generated photographic image of the installed bathtub enclosure partition assembly shown in FIG. 18.
Figure 23:
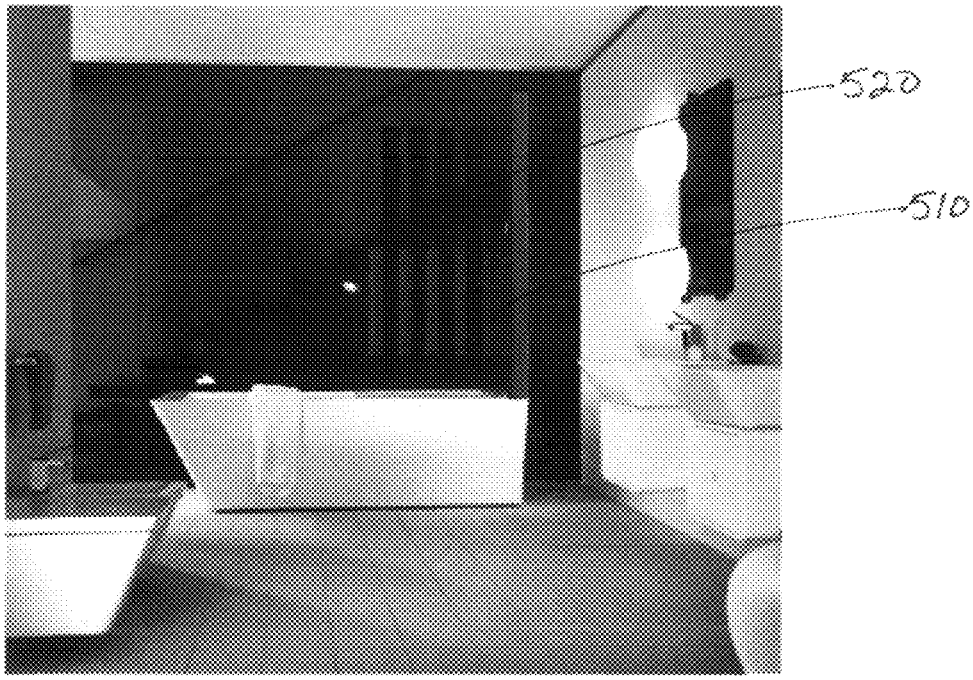
FIG. 23 is a computer generated photographic image of the installed bathtub enclosure partition assembly shown in FIG. 18.
Figure 24:
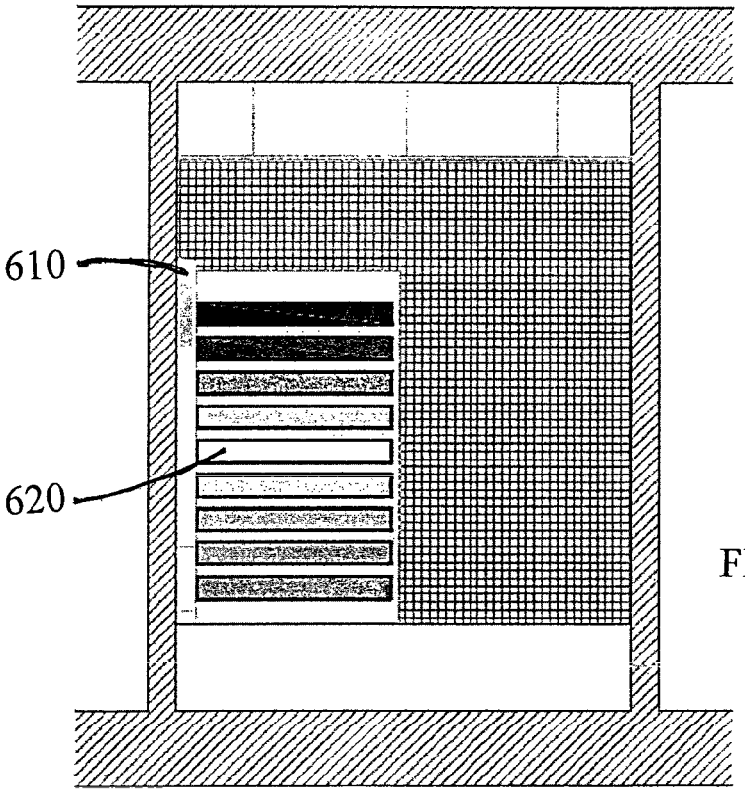
FIG. 24 is an exterior elevation view of a bathtub enclosure partition assembly in accordance with a preferred embodiment of the present invention installed on a bathtub, and which is provided with a drying air flow dispensing assembly having horizontally elongated drying air dispensing units.
Figure 25:
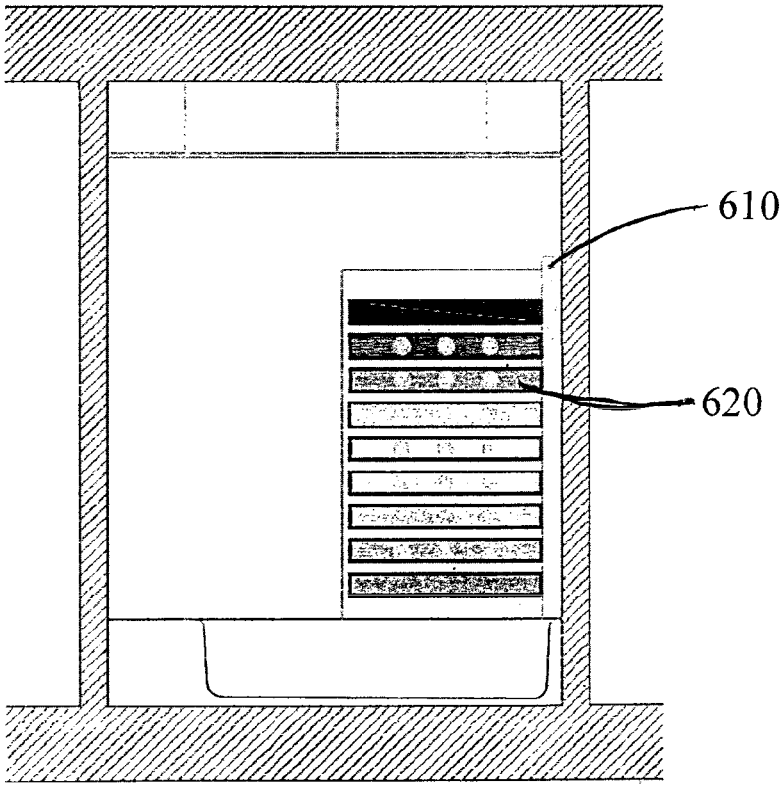
FIG. 25 is an interior elevation view of the installed bathtub enclosure partition assembly shown in FIG. 24.
Figure 26:
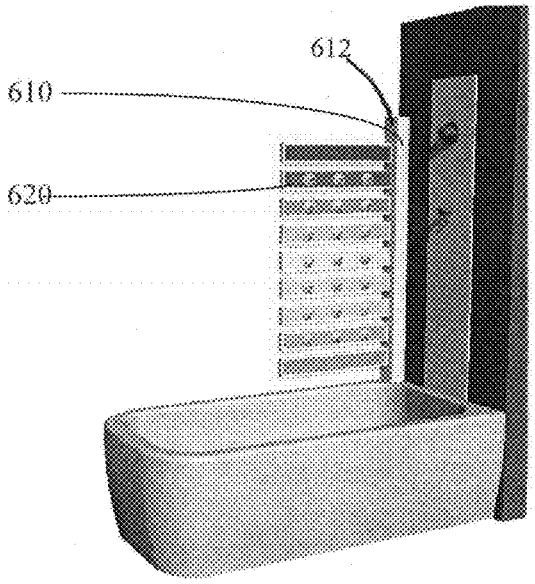
FIG. 26 is a perspective view of the installed bathtub enclosure partition assembly shown in FIG. 24.
Figure 27:
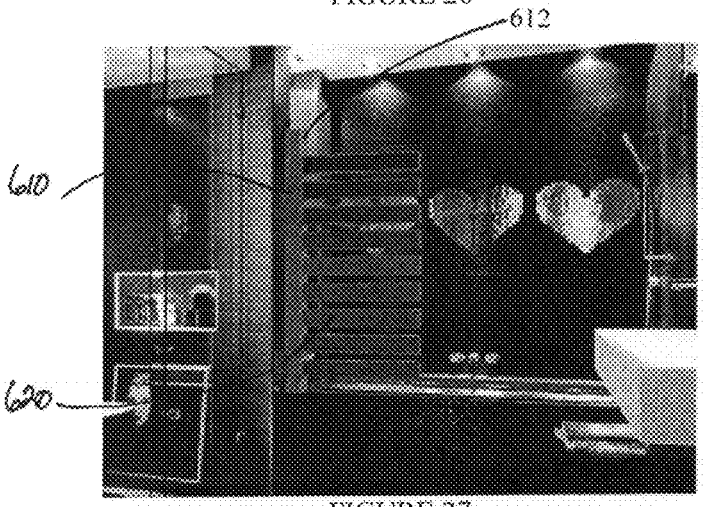
FIG. 27 is a computer generated photographic image of the installed bathtub enclosure partition assembly shown in FIG. 24.
Figure 28:
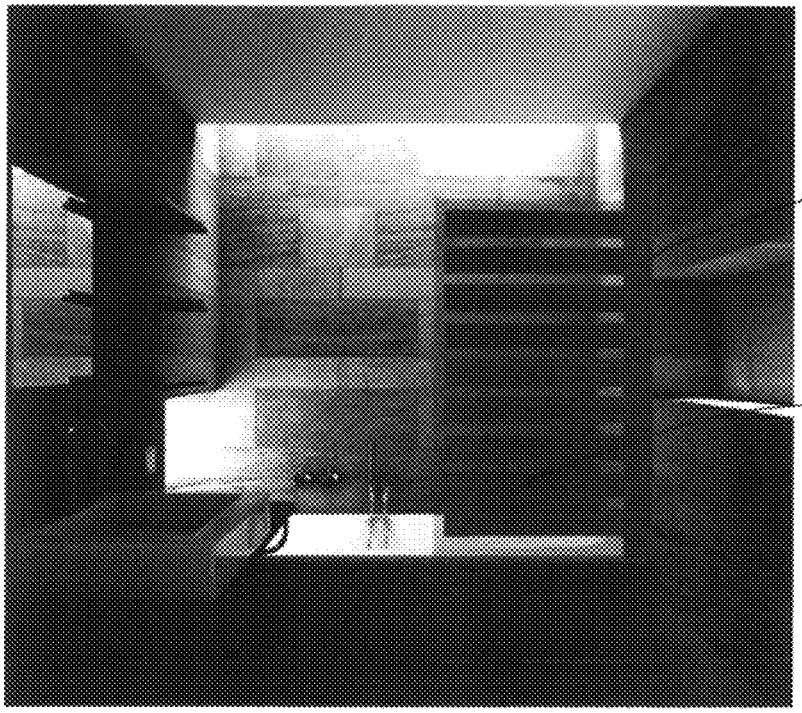
FIG. 28 is a computer generated photographic image of the installed bathtub enclosure partition assembly shown in FIG. 24.
Figure 29:
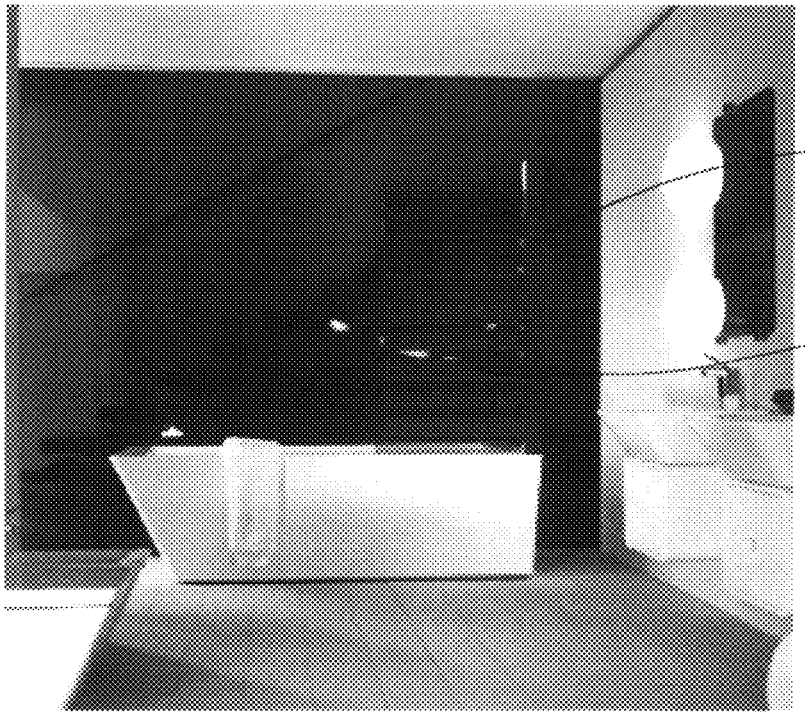
FIG. 29 is a computer generated photographic image of the installed bathtub enclosure partition assembly shown in FIG. 24.
Figure 30:
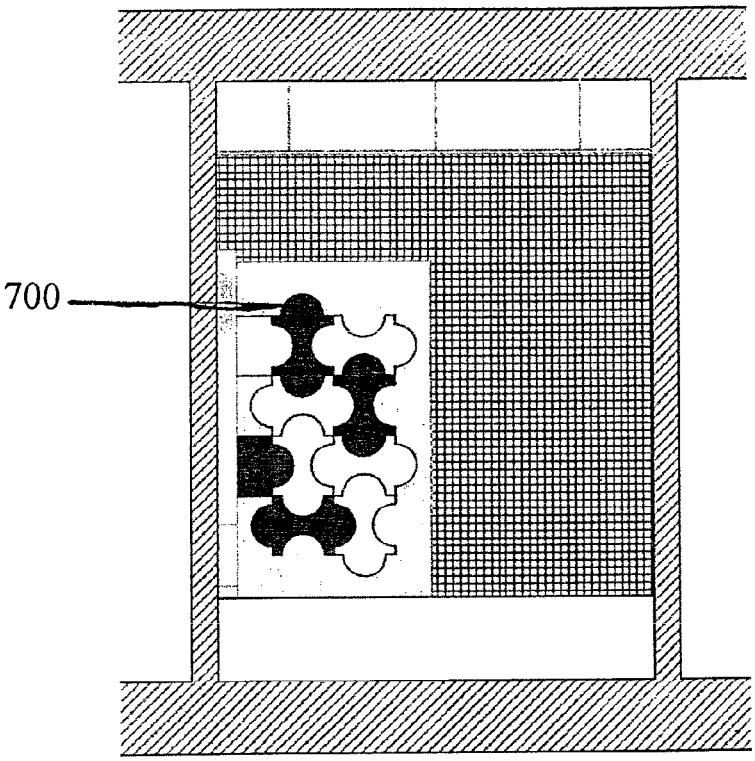
FIG. 30 is an exterior elevation view of a bathtub enclosure partition assembly in accordance with a preferred embodiment of the present invention installed on a bathtub, and which is provided with a drying air flow dispensing assembly having interconnectable modular air dispensing units.
Figure 31:
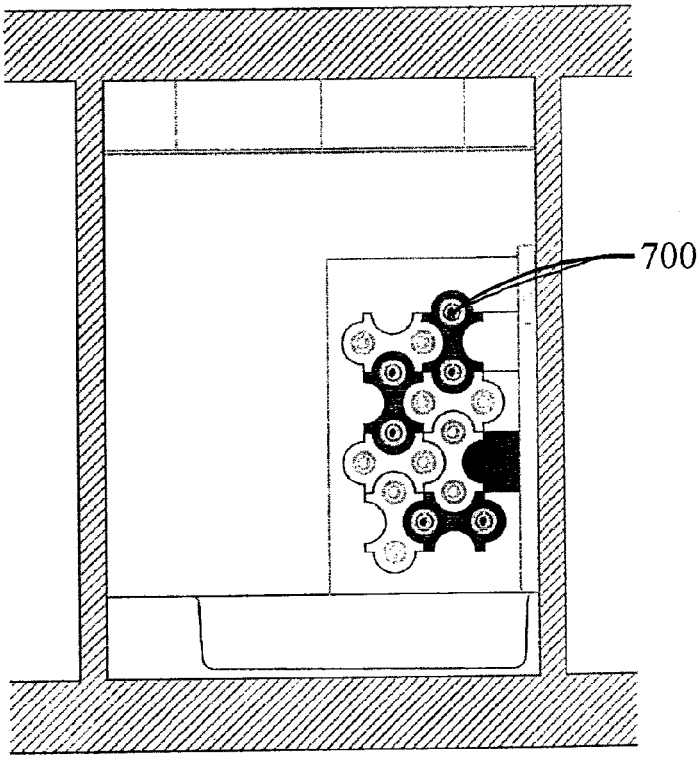
FIG. 31 is an interior elevation view of the installed bathtub enclosure partition assembly shown in FIG. 30.
Figure 32:
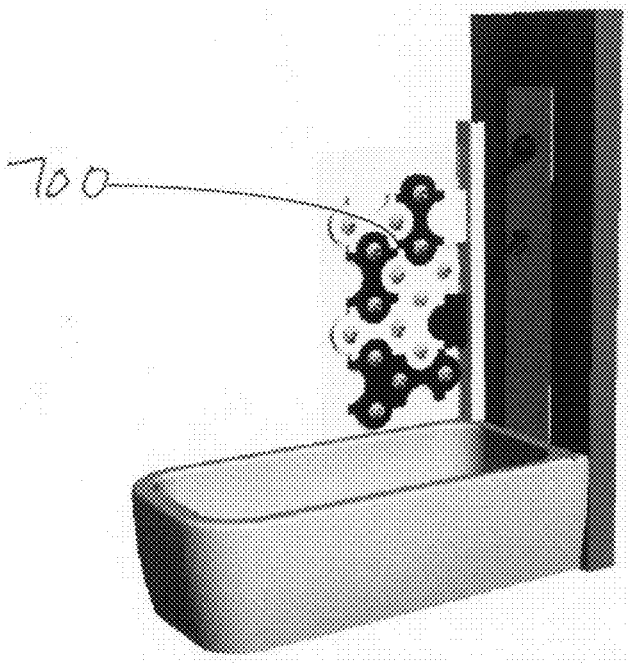
FIG. 32 is a perspective view of the installed bathtub enclosure partition assembly shown in FIG. 30.
Figure 33:
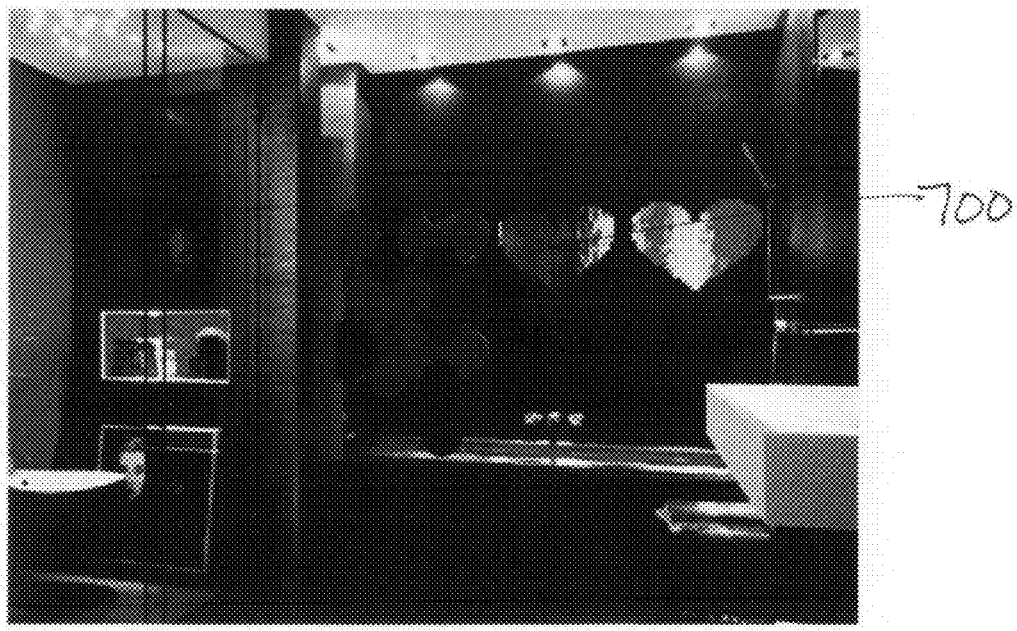
FIG. 33 is a computer generated photographic image of the installed bathtub enclosure partition assembly shown in FIG. 30.
Figure 34:
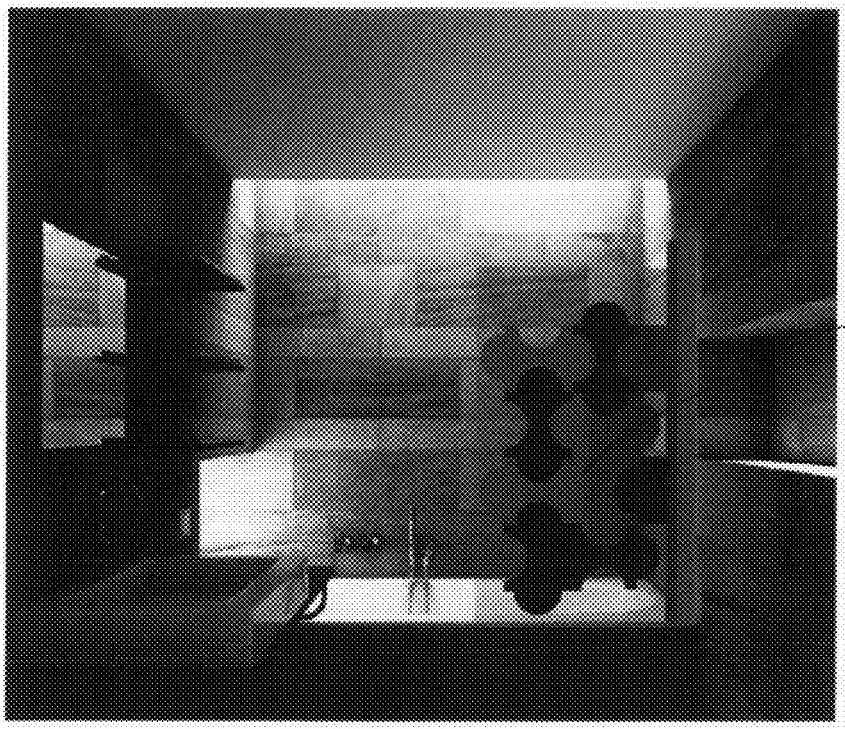
FIG. 34 is a computer generated photographic image of the installed bathtub enclosure partition assembly shown in FIG. 30.
Figure 35:
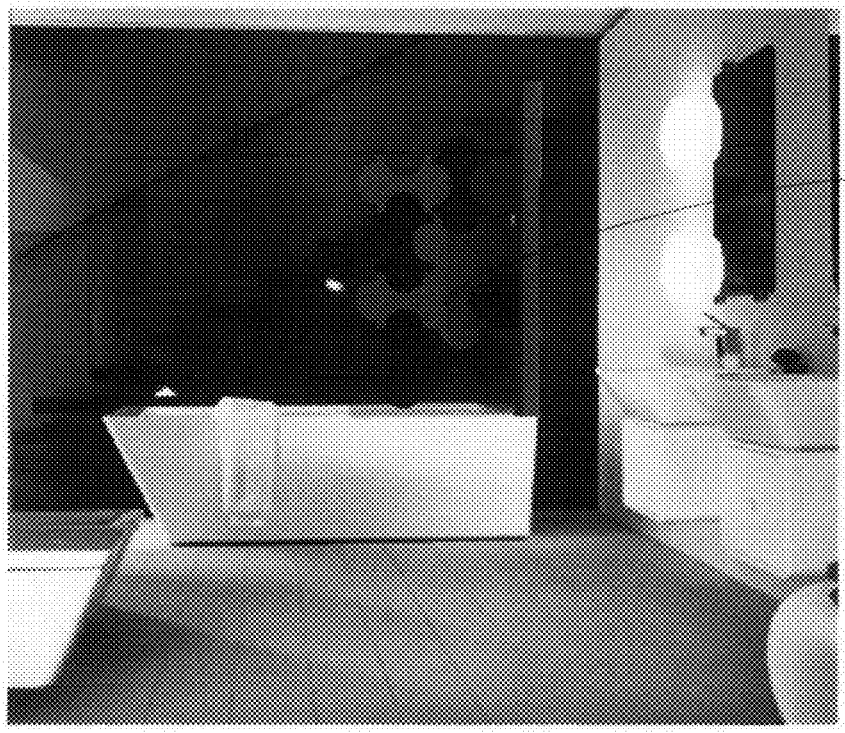
FIG. 35 is a computer generated photographic image of the installed bathtub enclosure partition assembly shown in FIG. 30.

As seen in FIGS. 10 and 11, for assembly and installation the support housing 32 is secured to an abutting bathroom wall 200 located adjacent to an alcove bathtub 300, such that a bottommost surface or bottommost anchoring surface 33 of the support housing 32 is rested on an exterior sidewall 310 of the bathtub 300. A lateral edge of the enclosure glass pane 80 is slidably inserted into the engagement channel 44 over the bathtub sidewall, preferably until the lateral edge of the glass pane 80 is in abutting contact with the bathroom wall 200. The lateral air receiving portion 106 of the manifold body 102 is inserted into the air flow supply port 43 of the support housing 32 in a cantilevered arrangement.

It is to be appreciated that the air flow fan 54 and the coiled wire 56 are not limited to the specific placement within the support housing 32 as described above. In a most preferred embodiment, for improved safety and to reduce the risk of an electric shock which may be caused by contact with water, moisture or steam during operation, both the air flow fan 54 and the coiled wire 56 are disposed in the exterior housing portion 40, such that all electrical components of the supply assembly 30 are located in the exterior housing portion 40, and separated from the interior of the bathtub 300 with the glass pane 80 therebetween. The glass pane 80 is preferably sealingly inserted in the engagement channel 44 to further reduce any moisture from the bathtub coming into contact with the exterior housing portion 40.

It is to be further appreciated that the dispensing assembly 100 is not limited to the specific configurations and arrangements as described above. Particularly, depending on the specific designs and appearance as may be desired by a user, the bathtub enclosure partition assembly may for example be provided with a honeycomb patterned drying air flow dispensing assembly 400 as shown in FIGS. 12 to 17. For fluid communication with the dispensing assembly 400, a vertically extended support housing 432 forming part of the bathtub enclosure partition assembly defines on a lateral surface upper and lower air flow supply ports 443, 444 for complementary engagement with associated upper and lower air receiving portions extending from the dispensing assembly 400.

In another embodiment illustrated in FIGS. 18 to 23, the bathtub enclosure partition assembly is provided with a drying air flow dispensing assembly 500 having a drying air distribution multiplier 510 fluidically coupled to a plurality of vertical slab air dispensing units 520. In yet another embodiment shown in FIGS. 24 to 29, the bathtub enclosure partition assembly has a vertically extended support housing 610 having an air venting surface 612 defining a plurality of vertically spaced air flow supply ports sized to slidably receive associated horizontally elongated drying air dispensing units 620. In yet another embodiment depicted in FIGS. 30 to 35, the bathtub enclosure partition assembly includes a plurality of interconnectable modular air dispensing units 700. Each of the modular air dispensing units 700 are fluidically coupled to one or more other modular air dispending units in a user selectable geometric arrangement.

As seen in FIGS. 17, 23, 29 and 35, it is to be appreciated that the bathtub enclosure partition assembly may be installed on a bathtub other than the alcove bathtub 300 with three-walled enclosure, such as a free standing bathtub located away from any bathroom walls. For installation on the free standing bathtub, the support housing 32 is preferably provided without the wall attachment bracket plates 39, and rather includes on a bottommost surface a bathtub sidewall attachment bracket. Alternatively, a bathtub sidewall could be provided with a vertically elongated coupling rod, and the bottommost surface of the support housing 32 defines a vertically extended bore sized to receive the coupling rod to effect engagement with the bathtub sidewall.

While the invention has been described with reference to preferred embodiments, the invention is not or intended by the applicant to be so limited. A person skilled in the art would readily recognize and incorporate various modifications, additional elements and/or different combinations of the described components consistent with the scope of the invention as described herein.

I claim:

1. A bathtub or shower stall enclosure partition assembly comprising:

a generally planar enclosure panel positionable in an erected position at least partially enclosing a bathtub or shower stall, the enclosure panel comprising interior and exterior facing major surfaces;

a dryer manifold assembly for providing a body or hair drying air flow, the dryer manifold assembly comprising a manifold array positionable adjacent to the interior facing major surface, wherein the manifold array comprises at least one air exhaust conduit having an air receiving end and an air dispensing outlet; and an air drive assembly comprising an air transfer duct extending from an air inlet to an air supply interface, and a heating element assembly selectively operable to provide a heated air flow from the inlet to the supply interface, the supply interface being provided for fluid communication with the air receiving end whereby actuation of the heating element assembly provides the heated air flow through the at least one air exhaust conduit and outwardly therefrom via the air dispensing outlet as the drying air flow, wherein the air drive assembly further comprises a columnar support for securing the enclosure panel in the erected position, the columnar support defining a substantially vertical channel sized for receiving a lateral edge of the enclosure panel in the securement of the enclosure panel thereto, and wherein the air transfer duct and the heating element assembly are coupled to or disposed in the columnar support.

2. The enclosure partition assembly of claim 1, wherein the columnar support defines generally parallel wet and dry elongated chambers fluidically joined by a transverse duct, the chambers being spaced apart from each other to define the vertical channel therebetween whereby the wet chamber is positionable adjacent to the interior facing major surface and the dry chamber is positionable adjacent to the exterior facing major surface, and wherein the heating element assembly is coupled to or disposed in the dry chamber.

3. The enclosure partition assembly of claim 1, wherein the columnar support further comprises a bottommost anchoring surface for securing the enclosure partition assembly to a top surface of a bathtub sidewall.

4. The enclosure partition assembly of claim 1, wherein the columnar support further comprises a lateral attachment surface for securing the enclosure partition assembly to the shower stall, or a wall adjacent to the bathtub or shower stall.

5. The enclosure partition assembly of claim 1, wherein the enclosure panel is a shower stall door or wall.

6. The enclosure partition assembly of claim 1, wherein the enclosure panel is a hinged shower stall door, and the columnar support comprises an enclosure hinge for hingedly coupling the shower stall door to the shower stall.

7. The enclosure partition assembly of claim 1, wherein the dryer manifold assembly is mountable to the columnar support or the air transfer duct in a cantilevered arrangement thereto.

8. The enclosure partition assembly of claim 1, wherein the air supply interface comprises an air venting surface defining an array of air vents, and wherein the manifold array includes a plurality of said air exhaust conduits selectively connectable in fluid communication with the air vents.

9. The enclosure partition assembly of claim 1, wherein the manifold array comprises a plurality of said air exhaust conduits, each said conduit being an elongated conduit having a plurality of said air dispensing outlets, wherein the elongated conduit is positionable in a generally parallel orientation to the interior major surface with the air dispensing outlets oriented substantially normal to the interior major surface.

10. The enclosure partition assembly of claim 1, wherein the air exhaust conduit comprises a plurality of modular interconnectable conduits, each said modular conduit being fluidically coupleable to one or more of other said modular conduits, and wherein the modular conduits are selectively positionable in and demountable from a geometric configuration.

11. The enclosure partition assembly of claim 1, wherein the dryer manifold assembly further includes an air distribution multiplier connectable in fluid communication with the air supply interface and the air receiving end.

12. The enclosure partition assembly of claim 1, wherein the enclosure panel comprises a semi-transparent or transparent panel.

13. The enclosure partition assembly of claim 1, wherein the enclosure panel is a glass panel.

14. A body dryer assembly for providing a body or hair drying air flow in a bathtub or shower stall, the dryer assembly comprising:

a generally planar panel positionable in an erected position on or adjacent to the bathtub or shower stall, the panel comprising interior and exterior facing major surfaces;

an air drive assembly comprising:

a columnar support for securing the panel in the erected position, the columnar support defining a substantially vertical channel sized for receiving a lateral edge of the panel in the securement of the panel thereto;

an air transfer duct extending from an air inlet to an air supply interface, the air transfer duct being disposed in or coupled to the columnar support; and a heating element assembly selectively operable for providing a heated air flow from the air inlet to the air supply interface, the heating element assembly being disposed in or coupled to the columnar support; and a dryer manifold assembly for dispensing the drying air flow, the dryer manifold assembly being mountable to the columnar support or the air transfer duct in a cantilevered arrangement thereto, wherein the dryer manifold assembly comprises a manifold array positionable adjacent to the interior facing major surface, the manifold array comprising at least one air exhaust conduit having an air receiving end and an air dispensing outlet;

wherein the air supply interface is provided for fluid communication with the air receiving end whereby actuation of the heating element assembly provides the heated air flow through the at least one air exhaust conduit and outwardly therefrom via the air dispensing outlet as the drying air flow.

15. The body dryer assembly of claim 14, wherein the columnar support defines generally parallel wet and dry elongated chambers fluidically joined by a transverse duct, the chambers being spaced apart from each other to define the vertical channel therebetween whereby the wet elongated chamber is positionable adjacent to the interior facing major surface and the dry elongated chamber is positionable adjacent to the exterior facing major surface, and wherein the heating element assembly is coupled to or disposed in the dry elongated chamber.

16. The body dryer assembly of claim 14, wherein the columnar support further comprises a bottommost anchoring surface for securing the body dryer assembly to a top surface of a bathtub sidewall.

17. The body dryer assembly of claim 14, wherein the columnar support further comprises a lateral attachment surface for securing the body dryer assembly to the shower stall, or a wall adjacent to the bathtub or shower stall.

18. The body dryer assembly of claim 14, wherein the air supply interface comprises an air venting surface defining an array of air vents, and wherein the manifold array includes a plurality of said air exhaust conduits selectively connectable in fluid communication with the air vents.

19. The body dryer assembly of claim 14, wherein the manifold array comprises a plurality of said air exhaust conduits, each said conduit being an elongated conduit having a plurality of said air dispensing outlets, wherein the elongated conduit is positionable in a generally parallel orientation to the interior major surface with the air dispensing outlets oriented substantially normal to the interior major surface.

20. The body dryer assembly of claim 14, wherein the air exhaust conduit comprises a plurality of modular interconnectable conduits, each said modular conduit being fluidically coupleable to one or more of other said modular conduits, and wherein the modular conduits are selectively positionable in and demountable from a geometric configuration.

21. The body dryer assembly of claim 14, wherein the dryer manifold assembly further includes an air distribution multiplier connectable in fluid communication with the air supply interface and the air receiving end.

22. The body dryer assembly of claim 14, wherein the panel is a glass enclosure panel for at least partially enclosing the bathtub or shower stall.

23. A bathtub or shower stall enclosure partition assembly comprising:

a generally planar enclosure panel positionable in an erected position at least partially enclosing a bathtub or shower stall, the enclosure panel comprising interior and exterior facing major surfaces;

a dryer manifold assembly for providing a body or hair drying air flow, the dryer manifold assembly comprising a manifold array positionable adjacent to the interior facing major surface, wherein the manifold array comprises at least one air exhaust conduit having an air receiving end and an air dispensing outlet; and an air drive assembly comprising an air transfer duct extending from an air inlet to an air supply interface, and a heating element assembly selectively operable to provide a heated air flow from the inlet to the supply interface, the supply interface being provided for fluid communication with the air receiving end whereby actuation of the heating element assembly provides the heated air flow through the at least one air exhaust conduit and outwardly therefrom via the air dispensing outlet as the drying air flow, wherein the air supply interface comprises an air venting surface defining an array of air vents, and wherein the manifold array includes a plurality of said air exhaust conduits selectively connectable in fluid communication with the air vents, wherein the air drive assembly further comprises a columnar support for securing the enclosure panel in the erected position, the columnar support defining a substantially vertical channel sized for receiving a lateral edge of the enclosure panel in the securement of the enclosure panel thereto, and wherein the air transfer duct and the heating element assembly are coupled to or disposed in the columnar support, and wherein the columnar support defines generally parallel wet and dry elongated chambers fluidically joined by a transverse duct, the chambers being spaced apart from each other to define the vertical channel therebetween whereby the wet chamber is positionable adjacent to the interior facing major surface and the dry chamber is positionable adjacent to the exterior facing major surface, and wherein the heating element assembly is coupled to or disposed in the dry chamber.

24. The enclosure partition assembly of claim 23, wherein the columnar support further comprises a bottommost anchoring surface for securing the enclosure partition assembly to a top surface of a bathtub sidewall.

25. The enclosure partition assembly of claim 23, wherein the columnar support further comprises a lateral attachment surface for securing the enclosure partition assembly to the shower stall, or a wall adjacent to the bathtub or shower stall.

26. The enclosure partition assembly of claim 23, wherein the enclosure panel is a shower stall door or wall.

27. The enclosure partition assembly of claim 23, wherein the enclosure panel is a hinged shower stall door, and the columnar support comprises an enclosure hinge for hingedly coupling the shower stall door to the shower stall.

28. The enclosure partition assembly of claim 23, wherein the dryer manifold assembly is mountable to the columnar support or the air transfer duct in a cantilevered arrangement thereto.

29. The enclosure partition assembly of claim 23, wherein the manifold array comprises a plurality of said air exhaust conduits, each said conduit being an elongated conduit having a plurality of said air dispensing outlets, wherein the elongated conduit is positionable in a generally parallel orientation to the interior major surface with the air dispensing outlets oriented substantially normal to the interior major surface.

30. The enclosure partition assembly of claim 23, wherein the air exhaust conduit comprises a plurality of modular interconnectable conduits, each said modular conduit being fluidically coupleable to one or more of other said modular conduits, and wherein the modular conduits are selectively positionable in and demountable from a geometric configuration.

31. The enclosure partition assembly of claim 23, wherein the dryer manifold assembly further includes an air distribution multiplier connectable in fluid communication with the air supply interface and the air receiving end.

32. The enclosure partition assembly of claim 23, wherein the enclosure panel comprises a semi-transparent or transparent panel.

33. The enclosure partition assembly of claim 23, wherein the enclosure panel is a glass panel.

* * * * *